US006029813A

United States Patent [19]

Smolenski

[11] Patent Number: 6,029,813

[45] Date of Patent: Feb. 29, 2000

[54] INSERT FOR GOLF CLUB BAG HAVING AN IMPROVED COVER AND AN ADJUSTABLE LENGTH SHAFT ASSEMBLY

[76] Inventor: Gregg J. Smolenski, 1535 Providence Rd., Charlotte, N.C. 28207

[21] Appl. No.: 09/190,984

[22] Filed: Nov. 12, 1998

[51] Int. Cl.[7] ..... A63B 65/00

[52] U.S. Cl. ..... 206/315.4

[58] Field of Search ..... 206/315.4, 315.3, 206/315.2; 135/99, 98, 141, 142, 120.1, 120.3

[56] References Cited

U.S. PATENT DOCUMENTS

| | | | |
|---|---|---|---|
| D. 371,000 | 6/1996 | Smolenski . | |
| 1,642,530 | 9/1927 | Barbour | 135/99 |
| 2,530,765 | 11/1950 | Greenup | 135/98 |
| 3,606,372 | 9/1971 | Browning | 16/115 X |
| 4,200,133 | 4/1980 | Whitlow . | |
| 4,512,465 | 4/1985 | Jobe | 206/315.4 |
| 4,522,300 | 6/1985 | Hamblet | 206/315.4 |
| 4,788,996 | 12/1988 | Forshee | 206/315.7 X |
| 4,979,548 | 12/1990 | Howard, III et al. . | |
| 5,024,259 | 6/1991 | Treadway . | |
| 5,620,034 | 4/1997 | Flis | 206/315.4 X |
| 5,738,208 | 4/1998 | Roubal | 206/315.4 |

FOREIGN PATENT DOCUMENTS

| | | |
|---|---|---|
| 208970 | 7/1940 | Germany . |
| 996730 | 12/1963 | United Kingdom . |

OTHER PUBLICATIONS

Offer for sale –International Product Design; dated Aug. 16, 1994.

*Primary Examiner*—Gary E. Elkins
*Assistant Examiner*—Tri M. Mai
*Attorney, Agent, or Firm*—Kennedy Covington Lobdell & Hickman

[57] ABSTRACT

An insert for placement within a golf club bag includes first and second elongate shaft members and a coupling sleeve configured to receive an end of the first shaft member and end of the second shaft therein for connecting the shaft members together in end-to-end relation. A second end of one of the shaft members is also configured for attachment of a cover disposed over the top of the golf club bag for protection of clubs carried in the bag from impacts. A pin extends through apertures in the shafts members and coupling sleeve to releasably secure the two shafts and coupling sleeve together in the coupling position. The coupling position is one of a plurality of selectable coupling positions. Each coupling position corresponds to a different length of the shaft assembly formed by the first and second shafts and coupling sleeve, the overall length of the shaft assembly being adjustable for accommodating any golf club height of a golf club carried in the bag. The cover includes ribs formed therein for rigidity and a protected area consisting only of a substantially open and non-compartmentalized annular space within which club heads of the taller clubs carried in the bag are received without regard to any particular orientation of the club heads to the ribs.

13 Claims, 4 Drawing Sheets

INSERT FOR GOLF CLUB BAG HAVING AN IMPROVED COVER AND AN ADJUSTABLE LENGTH SHAFT ASSEMBLY

FIELD OF THE PRESENT INVENTION

The present invention relates generally to a cover for a golf club bag and, more particularly, to an insert for a golf club bag which includes a cover that protects golf clubs retained within the bag and a shaft assembly which extends from the bottom to the top of the golf club bag and supports the cover in its protective disposition over the top of the golf clubs.

BACKGROUND OF THE PRESENT INVENTION

Golf clubs often become damaged while being transported in a golf club bag, even if club head covers are placed on the club heads. These club head covers, while effective at preventing scratches on the club heads, are ineffective against high impacts to the golf clubs which often occur during transportation. For instance, if the bag and clubs are transported in a vehicle, the bag often violently shifts position. In addition, if the bag is dropped from a plane's cargo hold or conveyor, the weight of the bag can cause the clubs to break or bend upon impact with the ground.

A convenient and easy-to-use cover for a golf club bag which absorbs such high impacts thereby protecting the golf clubs carried in the bag is illustrated in U.S. Pat. No. D371,000 which issued to Gregg J. Smolenski in 1996. The cover illustrated therein actually is part of an insert for a golf club bag and the cover not only protects the golf clubs carried in the bag but also separates groups of the golf club heads of the taller golf clubs into separate compartments of the cover. The cover, a unitary shaft, and a base member constitute the insert illustrated in U.S. Pat. No. D371,000.

In particular detail, the cover in U.S. Pat. No. D371,000 encompasses and protects golf club heads, and the cover is secured above the bag by attachment to the shaft which extends the length of the bag from the top thereof to a base member which supports the shaft on the bottom platform of the bag. The cover itself includes an annular section that is collinear with the shaft and protects club heads from side impact. Tapering sides of the cover extend from the annular section to a circular top section which together protect tops of the club heads. A cover attachment member extends within a protected area—enclosed and defined by the annular and tapering sides and the circular top section—away from the circular top section and is dimensioned to securely receive within a recess formed therein an end of the shaft. To provide rigid support to the annular section, planar support walls extend from the top and tapering sides between the cover attachment member and the annular sections. Moreover, the support walls further serve to separate the protected, enclosed area into compartments for the separation of groups of club heads of the taller golf clubs from one another. The cover illustrated in U.S. Pat. No. D371,000 includes four such walls.

The cover illustrated in U.S. Pat. No. D371,000 is designed to fit over the top of the golf club bag immediately adjacent the longest clubs carried in the bag, which typically includes a driver or two iron. Unfortunately, drivers and two irons come in varying lengths and, recently, some putters actually have been designed which exceed the length of drivers and two irons. Consequently, a disadvantage to the cover of U.S. Pat. No. D371,000 is that the shaft of each insert has a fixed length and therefore can only accommodate golf clubs having a particular range of lengths. A need therefore has developed for such a cover which can be used to cover any set of golf clubs carried in a golf club bag regardless of the particular length of any one of the clubs.

Another disadvantage of the cover of U.S. Pat. No. D371,000 is that it has been found that the support walls are inconvenient since they in fact can interfere with the proper positioning of the cover on top of the golf club bag; for proper positioning, the club heads of the taller clubs must first be aligned for receipt within one of the compartments defined by the support walls. A need therefore exits for a cover like that shown in U.S. Pat. No. D371,000 but which can be properly positioned over a bag without regard to the orientation of the golf club heads of the taller clubs to the cover, but which retains sufficient rigidity to be effective in protecting the golf clubs from high impacts.

SUMMARY OF THE PRESENT INVENTION

Broadly described, the present invention comprises an insert that includes a cover for positioning over a top of a golf club bag, with the cover being sufficiently rigid to withstand impacts and protect the golf clubs placed in the bag. The insert also includes a shaft assembly comprising two components that can be secured together and retained in such disposition by a retainer or locking mechanism.

In greater detail, the insert includes a cover and a shaft assembly that is adapted to be placed within a golf club bag to extend from a bottom of the bag to the top of the bag, and the top end of the shaft assembly is configured to attach to the cover to secure it in its disposition over the bag. The shaft assembly serves to transfer the force of impacts to the cover to the bottom of the bag thereby diverting the impact force around the clubs. The shaft assembly comprises at least two components coupled together in a coupling position with a retainer or locking mechanism releasably securing the two components together in the coupling position.

In a feature of the present invention, the coupling position is preferably only one of a plurality of selectable coupling positions with each coupling position corresponding to a different overall length of the shaft assembly. Thus, the overall length of the shaft assembly can be adjusted to accommodate any particular height of a golf club carried in the bag.

In a preferred embodiment of the present invention, the shaft assembly of the insert includes first and second elongate shaft members and a coupling member. The coupling member is configured to receive an end of the first shaft member and an end of the second shaft member for connecting the shaft members together in end-to-end relation, with one of the shaft members also being configured at a second end thereof for attachment of the cover in its disposition over the bag.

In a feature of the preferred embodiment, the coupling member includes apertures formed therein and each shaft member includes a pair of collinear apertures formed therein. The coupling member further preferably comprises a sleeve defining a bore configured to receive ends of the shaft members therein such that apertures in the coupling member register with the pair of apertures in each shaft member, with retainers extending from side-to-side through the registered apertures for releasably locking the shaft members within the coupling member to form the shaft assembly.

In a further feature of the preferred embodiment, the coupling member further includes a plurality of apertures such that at least one shaft member can be retained at various extensions within the coupling member, the overall length of the shaft assembly thereby being adjustable whereby the insert is adaptable for use in a golf club bag carrying therein any golf club regardless of its height.

Furthermore, each retainer preferably comprises a male component releasably joined with a female component with the male component extending through first apertures in a shaft member and the coupling member and the female component extending through corresponding collinear apertures in the shaft member and coupling member to join with the male component within the shaft assembly to form the retaining member.

With regard to the cover, it preferably includes: an annular section collinear with the shaft assembly; tapering sides which extend from the annular section to a circular top section; a cover attachment member which extends away from the top section within a protected area defined by the annular section and tapering sides; and ribs formed in the cover with each rib extending in a plane from the top section across the tapering sides and down along the annular section. Furthermore, each rib protrudes only slightly into the protected area such that the protected area consists only of an open and non-compartmentalized annular space within which the club heads are received without regard to any particular orientation of the club heads to the ribs. Each rib also preferably includes a small triangular or semicircular portion at the junction of the tapering sections with the cover attachment member of the cover for greater rigidity of the cover.

The present invention also encompasses a golf club bag having an insert of the present invention as set forth above.

DETAILED DESCRIPTION OF THE PREFERRED EMBODIMENT OF THE PRESENT INVENTION

With reference to the Figures, the preferred embodiment of the present invention will now be described in detail.

Figure 1:
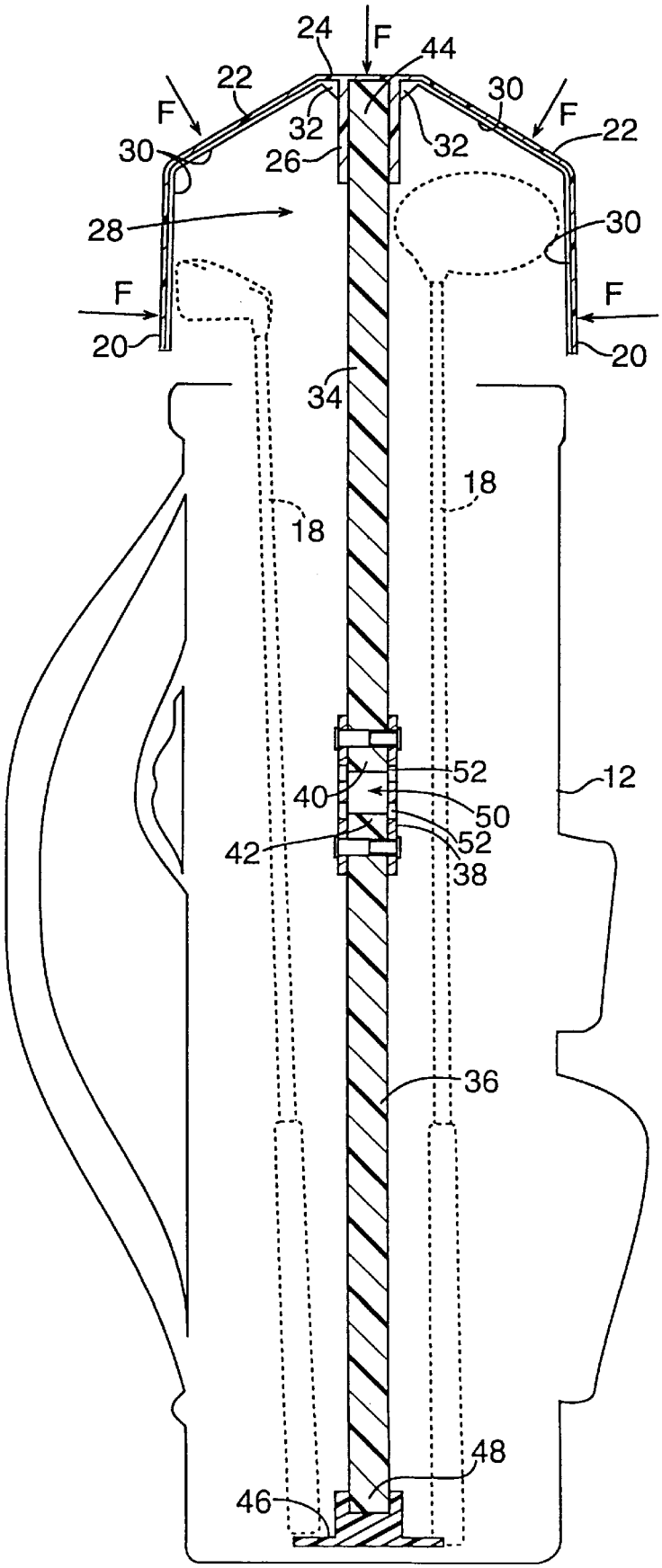
FIG. 1 is a cross-sectional view of a golf club bag and insert of the present invention.
Figure 2:
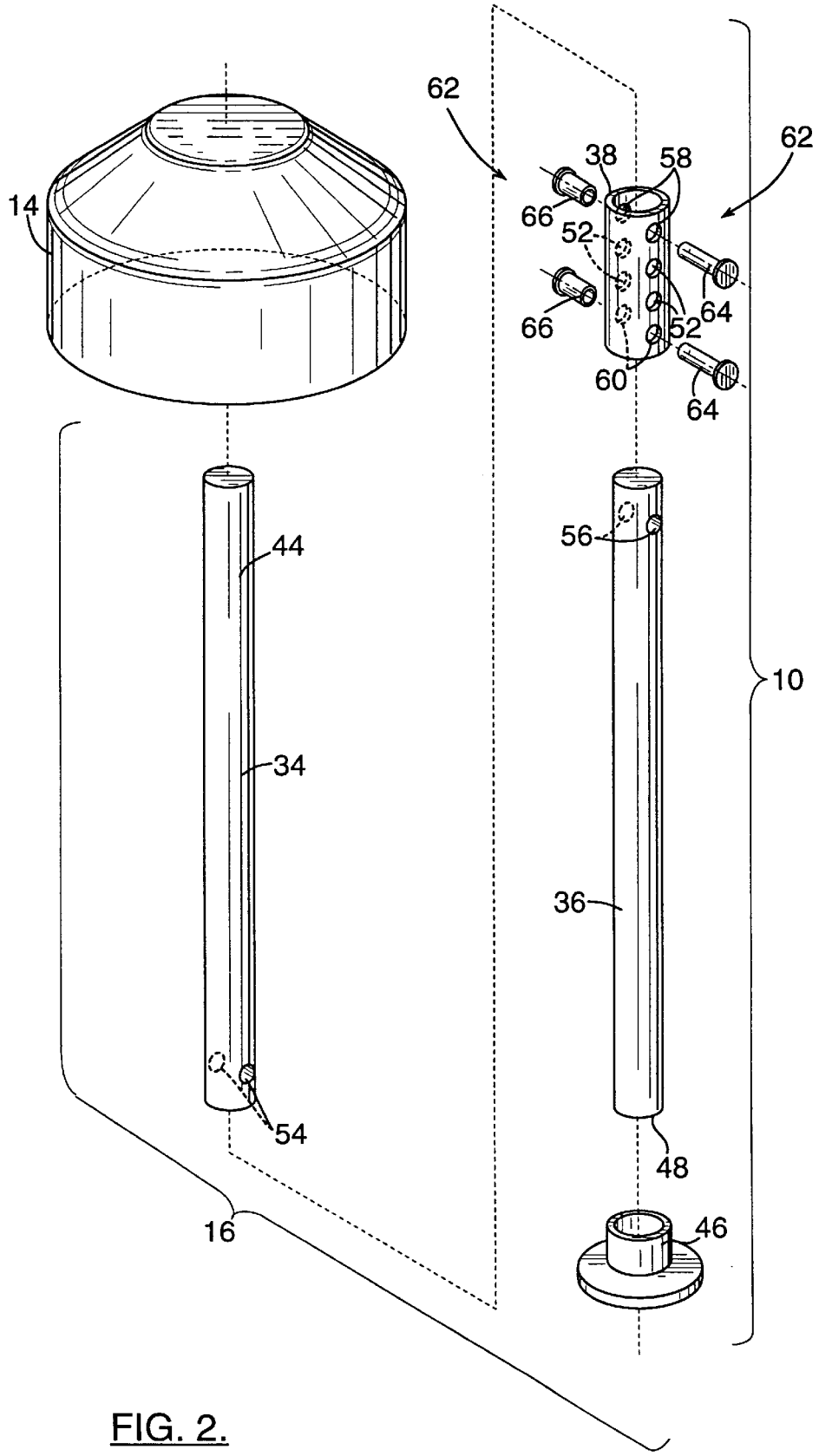
FIG. 2 is an exploded view of the insert of FIG. 1.
Figure 3:
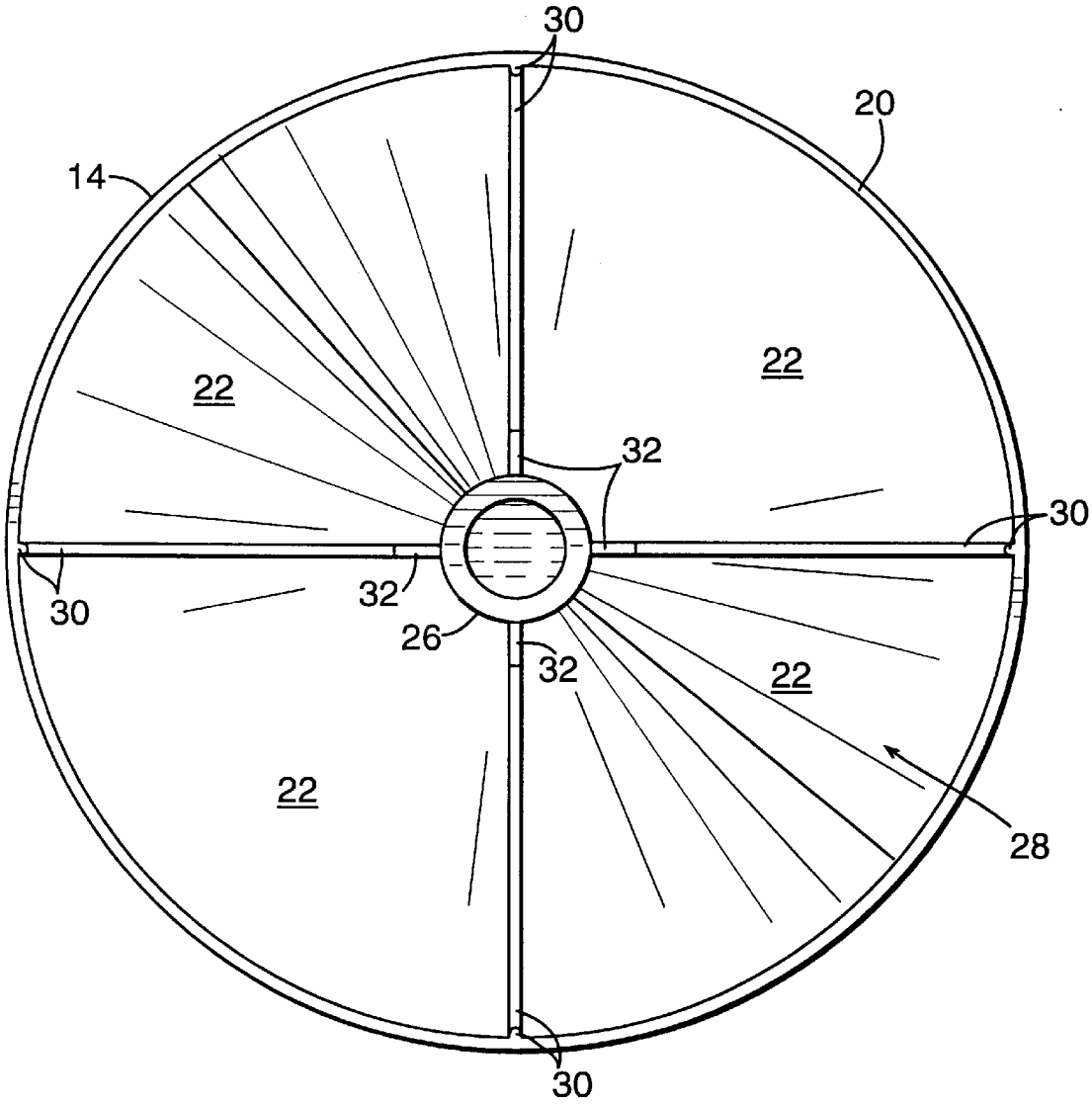
FIG. 3 is a bottom plan view of the cover of the insert of FIG. 1.

The preferred embodiment of the insert 10 of the present invention is shown in use in a golf club bag 12 in FIG. 1. The insert 10 comprises a cover 14 and a shaft assembly 16. The cover 14 serves to protect golf clubs 18 carried in the bag 12 from forces of impact F (illustrated by arrows) shown in FIG. 1 which can occur during bag transport. The shaft assembly 16 serves to support the cover 14 in its disposition over the top of the clubs 18 and serves to transfer the forces of impact F from the cover 14 to the bottom of the bag 12 and around the clubs 18 thereby protecting the clubs 18.

In greater detail, the cover 14 of the preferred embodiment is sufficiently rigid to withstand forces of impact F and protect the clubs 18 in the bag 12. Preferably, the cover 14 is manufactured from high-impact plastics or other material suitably rigid to protect the clubs 18. The cover 14 includes an annular section 20; tapering sides 22 which extend from the annular section 20 to a circular top section 24; and a cover attachment member 26 which extends away from the circular top section 24 within a protected annular area 28. The protected area 28 receives the golf club heads and is defined by the annular section 20 and the tapering sides 22, as well as the cover attachment member 26 which itself defines the center of the protected area 28, which is annularly shaped.

The cover 14 also includes ribs 30 which are preferably formed as part of the cover 14 with each rib 30 extending in a plane across the tapering sides 22 to and down the annular section 20. To provide increased rigidity to the cover 14, each rib 30 further preferably includes a raised corner portion, such as triangular portion 32, disposed at a junction of the tapering sides 22 with the cover attachment member 26. A semicircular portion could also be used as the triangular portion. In any event, each rib 30 only slightly protrudes into the protected area 28 such that the protected area 28 consists only of an open and non-compartmentalized annular space within which the club heads of the clubs 18 in the bag 12 are received. Thus, unlike in the prior art insert of 371,000, the taller club heads in the present invention do not have to be oriented to fit within compartments defined by support walls when the cover 14 is placed over the bag.

The cover attachment member 26 preferably includes a recess formed therein for slidable engagement with an end 44 of the shaft assembly 16. The cover attachment member 26 is disposed opposite the circular top section 24 in the center of the cover 14 to define the center of the annular protected area 28 of the cover 14. The cover 14 preferably is retained to the shaft assembly 16 by the frictional engagement between the cover attachment member 26 and the end 44 with the cover 14 and shaft assembly 16 being coaxial. However, it is also contemplated within the scope of the present invention that another equivalent attachment mechanism could be used, such as a threaded engagement or other locking mechanism like a detent mechanism.

The shaft assembly 16 of the present invention includes first and second elongate shaft members 34,36 and a coupling member 38. Each shaft member 34,36 preferably comprises an elongate hollow cylinder and, as discussed in detail below, the coupling member 38 preferably comprises a hollow cylindrical sleeve that is a separate piece from the two shaft members 34,36, although it is contemplated within the scope of the present invention that the coupling member could be integral with either one of the shaft members 34,36. Preferably, the coupling member 38 is configured to receive an end 40 of the shaft member 34. Furthermore, the coupling member 38 preferably is also configured to receive an end 42 of the other shaft member 36 for connecting the shaft members 34,36 together in end-to-end relation.

The shaft assembly 16 also preferably includes a base member 46 which includes a recess for slidably receiving therein in frictional engagement an end 48 of the shaft member 36. The base member 46 thereby supports the shaft assembly 16 against the bottom of the bag 12. Furthermore golf clubs 18 carried in the bag 12 rest against the top of the base member 46 and assist in keeping the base member 46 and the rest of the insert 10 from being pulled out of the bag 12 when the cover 14 is taken off of the shaft assembly 16.

In a feature of the present invention, the coupling member 38 preferably comprises a sleeve which defines a bore 50 that is configured to slidingly receive the ends 40,42 of the shaft members 34,36 therein to connect the shaft members 34,36 together to form an overall length of the shaft assembly 16. The coupling member 38 also preferably includes a plurality of apertures 52 formed therein and the shaft members 34,36 each preferably includes a pair of collinear apertures 54,56 formed therein whereby each pair of apertures 54,56 in the shaft members 34,36 register with differing pairs of apertures 58,60 in the coupling member 38 when each shaft member 34,36 is inserted within the coupling member 38 at various distances therein. Thus, the overall length of the shaft assembly 16 is adjustable and the insert 10 is adaptable for use in a golf club bag to protect a set of golf clubs 18 regardless of the height of any of the clubs 18.

Additionally, the insert 10 preferably includes retainers 62 which extend through registered apertures for locking the shaft members 34,36 together when the desired overall length of the shaft assembly 16 is obtained. Specifically, each retainer 62 includes a male component 64 joined with a female component 66. Thus, for example, with regard to the attachment of the shaft member 34 to the coupling member 38, the male component 64 of the retainer 62 is inserted through one of apertures 58 in the coupling member 38 and one of apertures 54 in the shaft member 34, and the female component 66 is inserted through the other of the collinear apertures 58 in the coupling member 38 and the other of the apertures 54 in the shaft member 34, whereby the male component 64 and the female component 66 join within the shaft assembly 16. Shaft member 36 is attached to the coupling member 38 in a corresponding manner.

Figure 4:
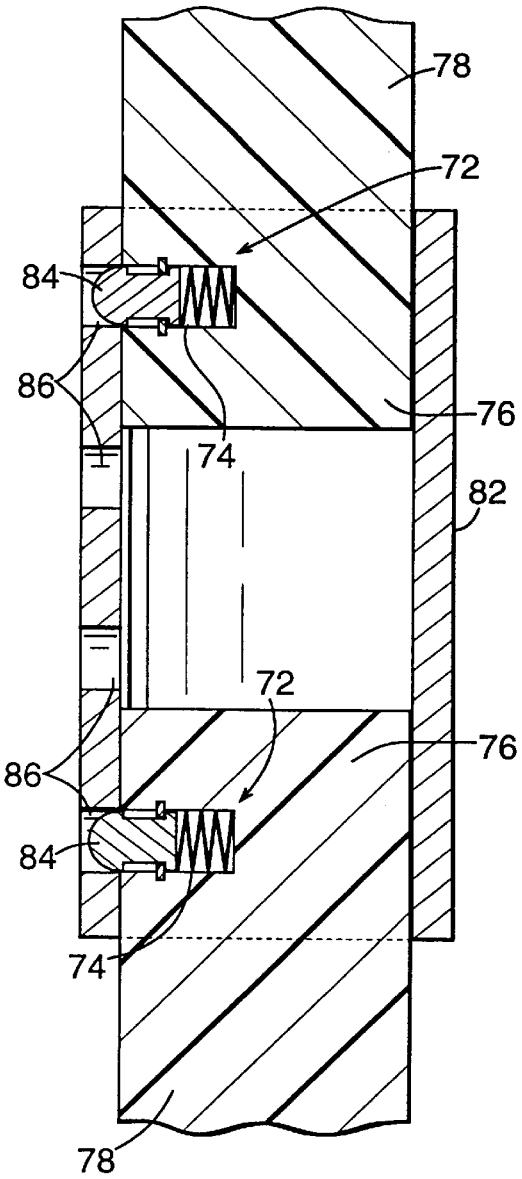
FIG. 4 is a cross-sectional view of an alternative coupling of the two shaft members of an insert of the present invention.
Figure 5:
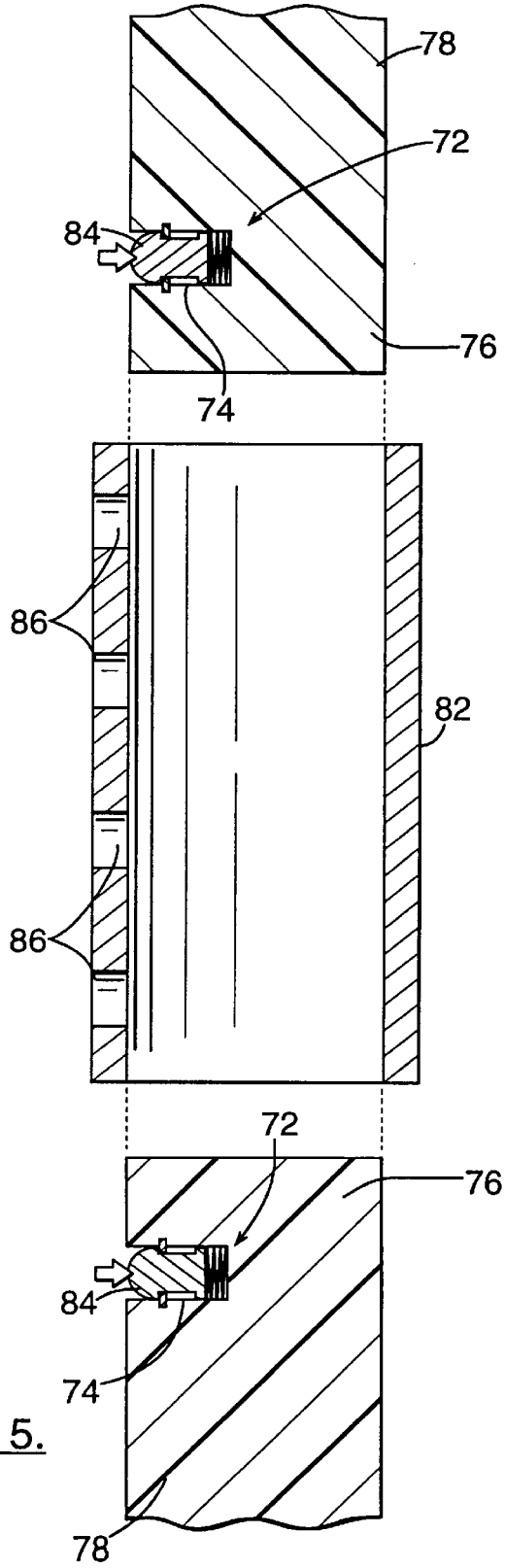
FIG. 5 is a cross-sectional view of the shaft members of FIG. 4 uncoupled.

In the preferred embodiment, the male and female components 64,66 join in threaded relation by screwing. Alternatively and within the scope of the present invention, the male and female components simply frictionally engage one another without screwing. In yet another alternative embodiment within the scope of the present invention, which is illustrated in FIGS. 4 and 5, detent mechanisms are utilized for releasably locking the shaft members 78 to the coupling member 82. Specifically, each detent mechanism 72 is retained within a compartment 74 formed in an end 76 of each shaft member 78 and includes a spring biased button 84 that is urged through apertures 86 formed in the coupling member 82 for releasably locking the shaft members 78 to the coupling member 82.

As will now be apparent to one having ordinary skill in view of the above, a benefit of a feature of the present invention is that the golf clubs carried in a golf club bag with which the insert is used need not have a specific maximum height since the insert is adjustable to accommodate any length of golf club sold in the marketplace. Thus, the preferred insert of the present invention can be used for any set of golf clubs having differing heights.

Furthermore, another benefit now apparent in view of the foregoing is the ease with which the cover can be placed on top of the bag over the heads of the clubs. This benefit results from the open and non-compartmentalized annular protective area that is defined by the cover within which the club heads are received.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An insert for use in a golf club bag for protection of golf clubs carried in the bag, said insert comprising:

(a) a cover for positioning over a top of the golf club bag for surrounding heads of golf clubs carried therein, said cover being sufficiently rigid to withstand impacts and protect the golf clubs in the bag, said cover including,
  (i) annular section;
  (ii) a top section;
  (iii) tapering sides which extend from said annular section to said top section;
  (iv) a cover attachment member extending away from said top sections said annular section, said tapering sides, and said cover attachment member defining the boundary of a protected area for receipt therein of the heads of the golf clubs; and
  (v) ribs formed in said cover with each said rib protruding only slightly into said protected area such that said protected area is substantially open and non-compartmentalized and consists of an open annular space, and (b) a shaft assembly adapted to be inserted into the bag and having a length dimensioned to extend from a bottom of the bag to the top of the bag, said shaft assembly being configured at an end thereof for attachment to said cover attachment member for the disposition of the cover over the top of the bag.

2. A golf club bag having an insert according to claim 1.

3. An insert according to claim 1, wherein said ribs extend along said annular section.

4. An insert according to claim 1, wherein said ribs extend from said cover attachment member across said tapering sides.

5. An insert according to claim 4, wherein a said rib includes a raised corner portion at the junction of said tapering sides with said cover attachment member.

6. An insert according to claim 1, wherein said shaft assembly includes first and second elongate shaft members and a sleeve configured to slide over an end of said first shaft member and an end of said second shaft member for coupling said shaft members together in end-to-end relation, one of said shaft members being configured at a second end thereof for attachment to said cover in its disposition over the top of the bag, said sleeve and said shaft members further including a plurality of apertures such that at least one of said shaft members can be retained at various extensions within said sleeve by a retainer extending through at least two of said apertures, an overall length of said shaft assembly thereby being adjustable whereby the insert is adjustable for accommodating any golf club height.

7. An insert for use in a golf club bag for protection of golf clubs carried in the bag, said insert comprising:

(a) a cover for positioning over a top of a golf club bag for protecting golf clubs carried therein, said cover being sufficiently rigid to withstand impacts and to protect the golf clubs in the bag, said cover including,
  (i) an annular section,
  (ii) tapering sides which extend from said annular section to a top section, (iii) a cover attachment member extending away from said top section, said annular section, said tapering sides and said cover attachment member defining the boundary of a protected area for receipt therein of the heads of the golf clubs, said cover attachment member being configured to receive said end of said shaft assembly, and (iv) ribs formed in said cover with each said rib extending in a plane from said top section across said tapering sides and along said annular section, said ribs protruding only slightly into said protected area such that said protected area consists of a substantially open and non-compartmentalized annular space within which club heads of the clubs in the bag are received without regard to orientation of the club heads with respect to said ribs, each said rib including a raised corner portion at the junction of said tapering sides with said cover attachment member; and (b) a shaft assembly adapted to be placed into the bag to extend from a bottom thereof to the top of the bag, an end of said shaft assembly being configured for attachment to said cover in its disposition over the clubs.

8. An insert according to claim 7, wherein said shaft assembly comprises, at least two components coupled together in one of a plurality of selectable coupling positions with each said coupling position corresponding to a different length of said shaft assembly whereby the length of said shaft assembly is adjustable; and means for releasably locking said two components in each of said selectable coupling positions.

9. An insert according to claim 7, wherein said shaft assembly comprises first and second elongate shaft members and a coupling member, said coupling member configured to receive an end of said first shaft member and an end of said second shaft member for connecting said shaft members together in end-to-end relation, said shaft assembly adapted to be placed into the bag and having a length dimensioned to extend from a bottom of the bag to the top of the bag, one of said shaft members being configured at a second end thereof for attachment to said cover attachment member for the disposition of the cover over the top of the bag.

10. An insert for use in a golf club bag for protection of golf clubs carried in the bag, said insert comprising:

(a) a cover for positioning over a top of a golf club bag for surrounding heads of golf clubs carried therein, said cover being sufficiently rigid to withstand impacts and protect the golf clubs in the bag, and (b) a shaft assembly including first and second elongate shaft members and a coupling member, said coupling member configured to receive an end of said first shaft member and an end of said second shaft member for connecting said shaft members together in end-to-end relation, said shaft assembly adapted to be placed into the bag and having a length dimensioned to extend from a bottom of the bag to the top of the bag, one of said shaft members being configured at a second end thereof for attachment to said cover in its disposition over the top of the bag, said coupling member including apertures formed therein and said shaft members including apertures formed therein, said coupling member defining a bore configured to receive said ends of said shaft members therein such that apertures in said shaft members register with apertures in said coupling member, said insert further including retainers extending through said registered apertures for locking said shaft members within said coupling member to form said shaft assembly, each said aperture in said shaft members and said coupling member including a corresponding collinear aperture formed therein such that each said retainer extends completely through said shaft assembly from one side to another side thereof and, specifically, through a pair of said collinear apertures in said coupling member and a pair of said collinear apertures in a said shaft member, each said retainer comprising a male component joined with a female component, said male component being insertable through a first aperture and said female component being insertable through said aperture collinear with said first aperture for joining with said male component within said shaft assembly.

11. An insert according to claim 10, wherein said cover comprises, (i) an annular section, (ii) tapering sides which extend from said annular section to a top section, (iii) a cover attachment member extending away from said top section, said annular section, said tapering sides and said cover attachment member defining a boundary of a protected area for receipt therein of the heads of the golf clubs, said cover attachment member being configured to receive said end of said shaft assembly, and (iv) ribs formed in said cover with each said rib extending in a plane from said top section across said tapering sides and along said annular section, said ribs protruding only slightly into said protected area such that said protected area consists of a substantially open and non-compartmentalized annular space within which club heads of the clubs in the bag are received without regard to orientation of the club heads with respect to said ribs, each said rib including a raised corner portion at the junction of said tapering sides with said cover attachment member.

12. An insert for use in a golf club bag for protection of golf clubs carried in the bag, said insert comprising:

a cover for positioning over a top of the golf club bag for surrounding heads of golf clubs carried therein, said cover being sufficiently rigid to withstand impacts and protect the golf clubs in the bag, and a shaft assembly including first and second elongate shaft members and a coupling member, said coupling member configured to receive an end of said first shaft member and an end of said second shaft member for connecting said shaft members together in end-to-end relation, said shaft assembly adapted to be placed into the bag and having a length dimensioned to extend from a bottom of the bag to the top of the bag, one of said shaft members being configured at a second end thereof for attachment to said cover in its disposition over the top of the bag, wherein said cover includes:

an annular section collinear with said shaft assembly;

a circular top section;

tapering sides which extend from said annular section to said circular top section;

a cover attachment member extending away from said top section within a protected area defined by said annular section, said tapering sides, and said cover attachment member, said cover attachment member configured to receive therein said second end of said one of said shaft members; and a plurality of ribs formed in said cover with each said rib extending in a plane from said top section across said tapering sides and along said annular section, said ribs protruding only slightly into said protected area such that said protected area consists of a substantially open and non-compartmentalized annular space within which club heads of the clubs in the bag are received without regard to orientation of the club heads with respect to said ribs.

13. An insert for positioning over a top of the golf club bag for surrounding heads of golf clubs carried therein, said cover being sufficiently rigid to withstand impacts and protect the golf clubs in the bag, and a shaft assembly including first and second elongate shaft members and a coupling member, said coupling member configured to receive an end of said first shaft member and an end of said second shaft member for connecting said shaft members together in end-to-end relation, said shaft assembly adapted to be placed into the bag and having a length dimensioned to extend from a bottom of the bag to the top of the bag, one of said shaft members being configured at a second end thereof for attachment to said cover in its disposition over the top of the bag, wherein said coupling member includes apertures formed therein and said shaft members includes apertures formed therein, said coupling member defining a bore configured to receive said ends of said shaft members therein such that apertures in said shaft members register with apertures in said coupling member, said insert further including retainers extending through said registered apertures for locking said shaft members within said coupling member to form said shaft assembly, each said retainer comprising a male component joined with a female component, said male component being insertable through a first said aperture amd said female component being insertable through a second said aperture collinear with said first aperture for joining with said male component within said shaft assembly.

* * * * *